US006125514A

United States Patent [19]

Yu

[11] Patent Number: 6,125,514

[45] Date of Patent: Oct. 3, 2000

[54] SAFETY CLAMP

[76] Inventor: Te-Cheng Yu, 5F, No. 34, Ming Chi Street, San Chung, Taipei Hsien, Taiwan

[21] Appl. No.: 09/343,194

[22] Filed: Jun. 30, 1999

[51] Int. Cl.[7] ..... A44B 21/00; B25B 25/00; B66D 5/00

[52] U.S. Cl. ..... 24/489; 24/68 CD; 24/68 R; 24/494; 24/573.5

[58] Field of Search ..... 24/489, 135 N, 24/68 CD, 68 R, 494, 573.3, 573.5, 265 CD; 410/100

[56] References Cited

U.S. PATENT DOCUMENTS

| | | | |
|---|---|---|---|
| 3,175,806 | 3/1965 | Prete, Jr. | 24/68 CD |
| 4,254,941 | 3/1981 | Tanson | 254/267 |
| 4,336,637 | 6/1982 | Patterson | 24/135 N |
| 4,825,513 | 5/1989 | Verespej | 24/135 N |
| 4,860,606 | 8/1989 | Rousseau | 410/100 |
| 5,186,586 | 2/1993 | Stephenson, Jr. | 410/100 |
| 5,542,798 | 8/1996 | Rawdon et al. | 24/68 CD |
| 5,624,087 | 4/1997 | Dick et al. | 242/381.1 |
| 5,855,045 | 1/1999 | Miura | 24/68 CD |

*Primary Examiner*—Victor N. Sakran
*Attorney, Agent, or Firm*—Dougherty & Troxell

[57] ABSTRACT

A safety clamp, which includes a link for connection to a crane or the like, a steering mechanism, the steering mechanism including a casing, a ratchet wheel mounted in the casing and connected to the link, and steering control means for controlling the direction of rotation of the ratchet wheel, a supporting bar connected to the casing, a movable bar connected to the ratchet wheel and turned with the ratchet wheel and the link relative to the casing and the supporting bar, and a clamping bar connected to the movable bar and worked with the supporting bar to hold an object between the clamping bar and the supporting bar for enabling the object to be lifted with the safety clamp.

7 Claims, 6 Drawing Sheets

SAFETY CLAMP

BACKGROUND OF THE INVENTION

The present invention relates to a safety clamp for use with a crane or the like to lift an object, and more particularly to such a safety clamp which is practical for lifting an object in a horizontal position as well as in a vertical position.

A variety of transportation and lifting mechanical devices have been developed, and are intensively used in factories, work places, etc., to lift or move heavy materials. When a crane or the like is used to lift for example steel materials, a clamp shall be used to secure the steel materials to the cable of the crane.

FIGS. 1 and 2 show two clamps for this purpose. The clamp shown in FIG. 1 is for vertical lifting operation. The clamp shown in FIG. 2 is for horizontal lifting operation. These clamps commonly comprises a substantially U-shaped base A, a toothed cam and a swivel jar B mounted in the U-shaped base A for holding down the object to be lifted, a safety spring latch C pressed on the toothed cam to stop the toothed cam in the clamping position, and a hanger D raised from the U-shaped base A for fastening to the cable of the crane.

These conventional clamps have numerous drawbacks as outlined hereinafter:

1) For a horizontal lifting operation or a vertical lifting operation, a different clamp must be used.
2) Due to limited contact area between the swivel jaw and the workpiece, the angle of oscillation of the workpiece must be kept within 10° angle relative to the clamp, and the workpiece will fall from the clamp if the angle of oscillation of the workpiece surpasses 10° angle relative to the clamp.
3) When two clamps are simultaneously used to lift a workpiece in horizontal, the distance between the clamps must be limited because the workpiece falls from the clamps when a lateral force is produced to tile the workpiece over 10° angle.
4) The workpiece tends to fall from the clamp when hit by external means, or when suddenly receiving zero pressure due to an operation error.
5) During lifting, the clamp must be prohibited from receiving a lateral force, and the workpiece tends to be forced away from the clamp if the clamp is hit laterally by an external object.

SUMMARY OF THE INVENTION

The present invention has been accomplished to provide a safety clamp, which eliminates the aforesaid drawbacks. It is one object of the present invention to provide a clamp, which is practical a vertical lifting operation as well as a horizontal lifting operation.

It is another object of the present invention to provide a clamp, which reinforces its clamping force on the workpiece when lifted, enabling the workpiece to be firmly secured in position during lifting.

According to one aspect of the present invention, the safety clamp comprises a link for connection to a crane or the like, a steering mechanism, the steering mechanism including a casing, a ratchet wheel mounted in the casing and connected to the link, and steering control means for controlling the direction of rotation of the ratchet wheel, a supporting bar connected to the casing, a movable bar connected to the ratchet wheel and turned with the ratchet wheel and the link relative to the casing and the supporting bar, and a clamping bar connected to the movable bar and worked with the supporting bar to hold an object between the clamping bar and the supporting bar for enabling the object to be lifted with the safety clamp.

According to another aspect of the present invention, the steering control means comprises a first pawl and a second pawl respectively pivoted to the casing inside the receiving chamber at two opposite sides of the ratchet wheel, a first spring member mounted inside the receiving chamber and connected between the casing and the first pawl to force the first pawl into engagement with the ratchet wheel, a second spring member mounted inside the receiving chamber and connected between the casing and the second pawl to force the second pawl into engagement with the ratchet wheel, a sector member pivoted to the casing inside the receiving chamber and spaced between the first pawl and the second pawl, and a handle suspended outside the casing and connected to the sector member for operation by hand to turn the sector member between a first position where the first pawl is disengaged from the ratchet wheel for enabling the ratchet wheel to be rotated in one direction, and a second position where the second pawl is disengaged from the ratchet wheel for enabling the ratchet wheel to be rotated in the reversed direction. Because the clamping bar is turned with the movable bar and the ratchet wheel, the clamping bar is firmly retained clamped on the workpiece against the supporting bar when the ratchet wheel is stopped from a backward rotation. Further, because the supporting bar and the clamping bar have a certain length, the contact area between the workpiece and the clamp is sufficient to have the workpiece be firmly secured to the clamp.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

Figure 2:
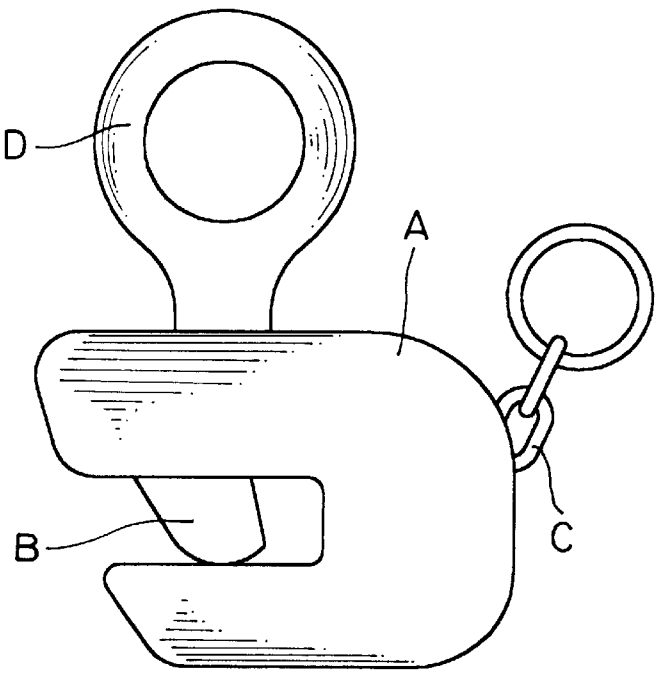
(PRIOR ART) FIG. 2
FIG. 2 illustrates a clamp for horizontal lifting according to the prior art.
Figure 1:
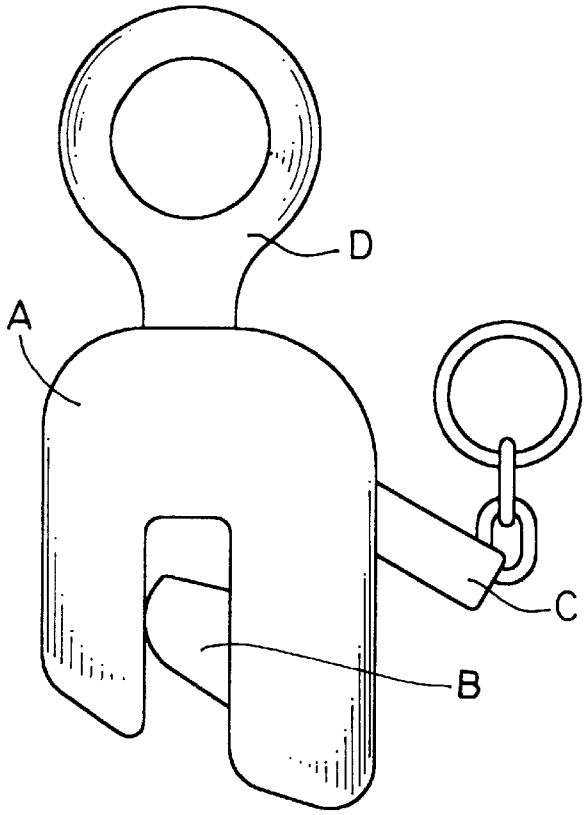
(PRIOR ART) FIG. 1
FIG. 1 illustrates a clamp for vertical lifting according to the prior art.
Figure 3:
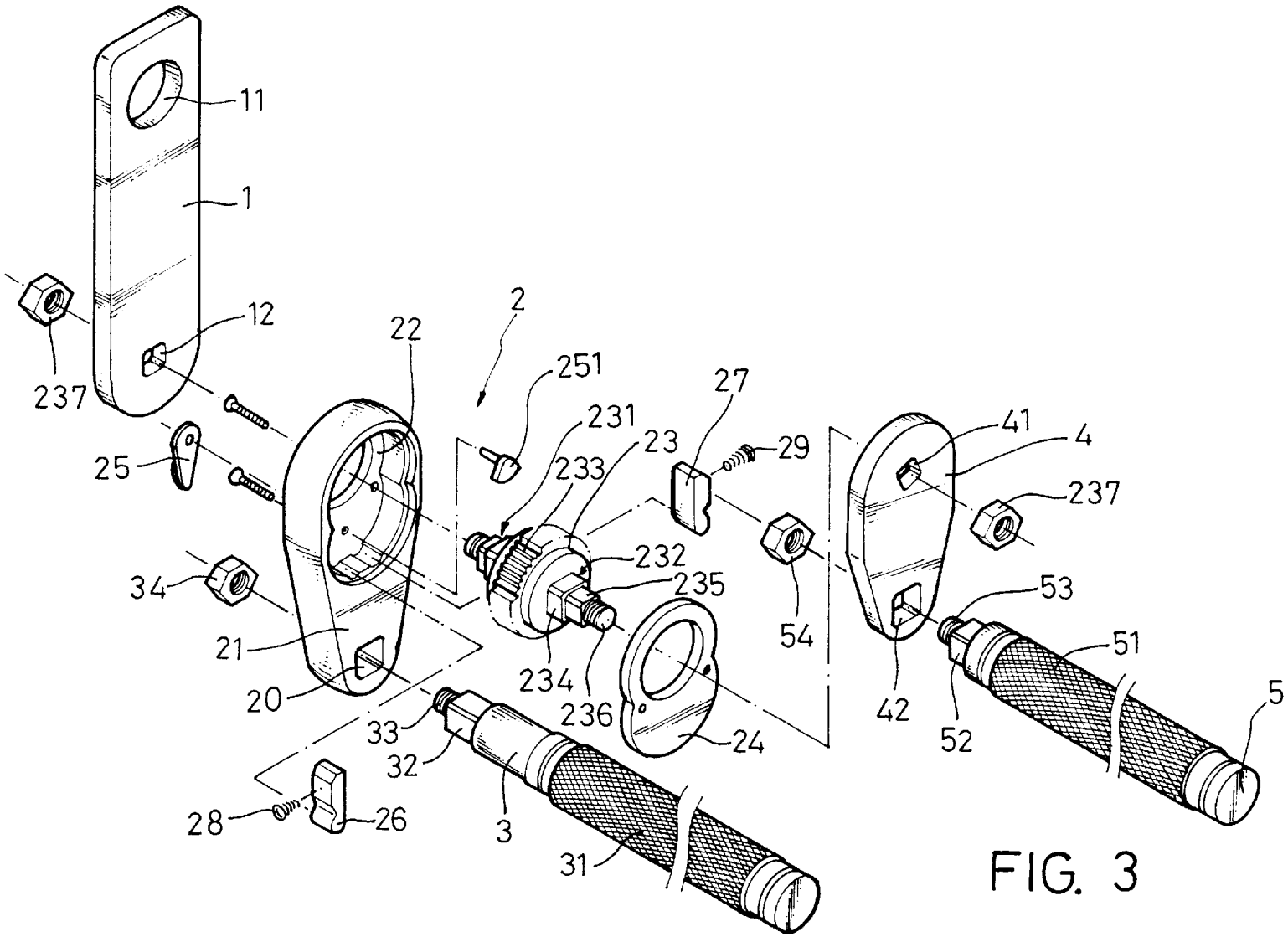
FIG. 3 is an exploded view of a safety clamp according to the present invention.

Referring to FIGS. from 3 through 5, a safety clamp in accordance with the present invention is generally comprised of a link 1, a steering mechanism 2, a supporting bar 3, a movable bar 4, and a clamping bar 5.

The link 1 is a flat, elongated plate having a hanging hole 11 at one end for fastening to for example a steel cable, and a coupling hole 12 at an opposite end for coupling to the steering mechanism 2.

Figure 4:
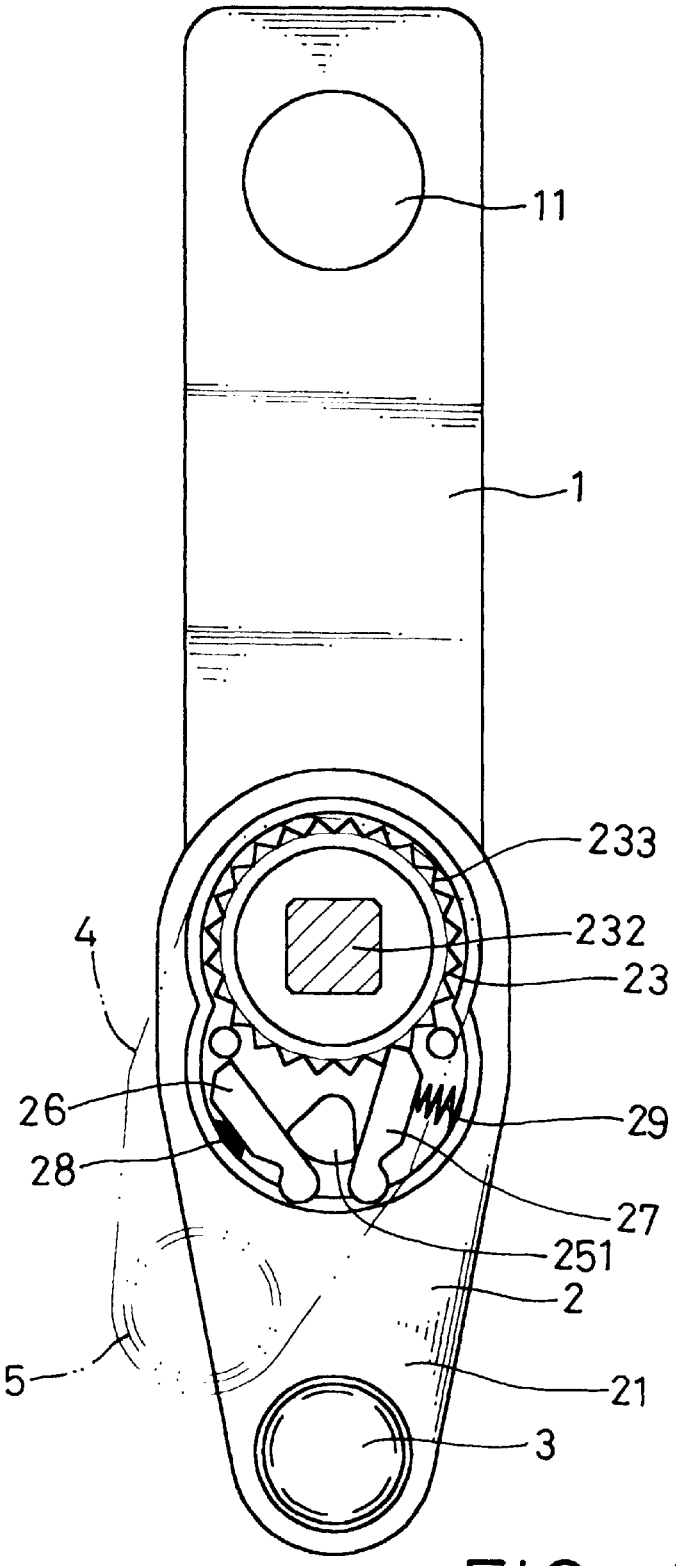
FIG. 4 is a sectional view of the present invention, showing the arrangement of the steering mechanism.
Figure 5:
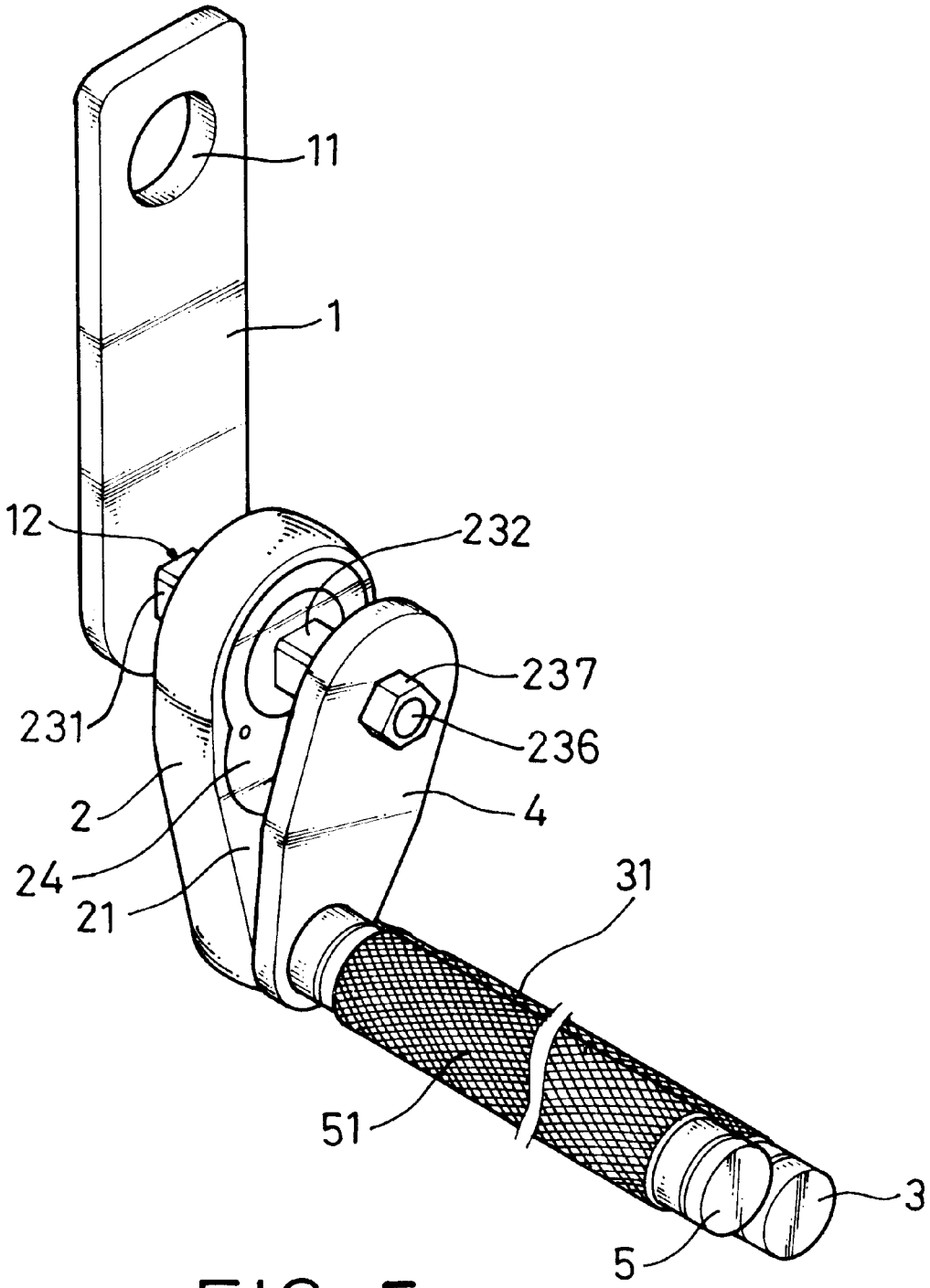
FIG. 5 is a perspective assembly view of the safety clamp according to the present invention.

The steering mechanism 2 comprises a casing 21 having a receiving chamber 22 and a locating hole 20 at two distal ends, a ratchet mechanism mounted in the receiving chamber 22, and a cover 24 covered on the receiving chamber 22 to hold the ratchet mechanism in place. The ratchet mechanism comprises a ratchet wheel 23, which comprises a set of sloping teeth 233 spaced around the periphery of the wheel body thereof, a first coupling rod 231 raised from the wheel body at one side and extended out of the back side of the casing 21 and coupled to the coupling hole 12 at the link 1 and a second coupling rod 232 raised from the wheel body at an opposite side and extended out of the cover 24 at the front side of the casing 21 and coupled to the movable plate 4, a first pawl 26 and a second pawl 27 respectively pivoted to the inside wall of the casing 21 within the receiving chamber 22 at two opposite sides of the ratchet wheel 23, a first spring member 28 mounted inside the receiving chamber 22 and connected between the inside wall of the casing 21 and the free end of the first pawl 26 to force the first pawl 26 into engagement with the sloping teeth 233 of the ratchet wheel 23, a second spring member 29 mounted inside the receiving chamber 22 and connected between the inside wall of the casing 21 and the free end of the second pawl 27 to force the second pawl 27 into engagement with the sloping teeth 233 of the ratchet wheel 23, a sector member 251 pivoted to the inside wall of the casing 21 within the receiving chamber 22 and spaced between the first pawl 26 and the second pawl 27, and a handle 25 suspended outside the casing 21 and connected to the sector member 251 for operation by hand to turn the sector member 251 between a first position where the first pawl 26 is disengaged from the sloping teeth 233 of the ratchet wheel 23 for enabling the ratchet wheel 23 to be rotated in one direction, and a second position where the second pawl 27 is disengaged from the sloping teeth 233 of the ratchet wheel 23 for enabling the ratchet wheel 23 to be rotated in the reversed direction (see FIG. 4).

The supporting bar 3 is an elongated rod member connected to the locating hole 20 at the casing 21 of the steering mechanism 2, having an embossed peripheral wall 31.

The movable bar 4 is a flat bar having a first coupling hole 41 and a second coupling hole 42 at two distal ends thereof. The first coupling hole 41 of the movable bar 4 is coupled to the second coupling rod 232 of the ratchet wheel 23. The second coupling hole 42 of the movable bar 4 is coupled to the clamping bar 5.

The clamping bar 5 is an elongated rod member connected to the second coupling hole 42 at the movable bar 4, having an embossed peripheral wall 31.

Further, in order to let the ratchet wheel 23, the link 1 and the movable bar 4 be firmly connected to one another, the ratchet wheel 23 must be specially designed. As illustrated, the first coupling rod 231 and second coupling rod 232 of the ratchet wheel 23 are symmetrical, each comprising a stop portion 234 stopped against the link 1 or movable bar 4 at one side, an insertion portion 235 fitted into the coupling hole 12 at the link 1 or the first coupling hole 41 at the movable bar 4, and a threaded portion 236 screwed up with a respective lock nut 237. The supporting bar 3 comprises an insertion portion 32 at its one end fitted into the locating hole 20 at the casing 21, and a threaded portion 33 axially extended from the insertion portion 32 and screwed up with a lock nut 34. The clamping bar 5 comprises an insertion portion 52 at its one end fitted into the second coupling hole 42 at the movable bar 4, and a threaded portion 53 axially extended from the insertion portion 52 and screwed up with a lock nut 54.

In order to achieve a satisfactory clamping effect, the contained angle between the link 1 and the movable bar 4 is preferably defined within 140° to 150° angle, or most preferably at about 145° angle. In order to obtain a satisfactory moment of force, the length of the link 1 is preferably about 2 to 4 times over the movable bar 4, or most preferably about 2.5 to 3 times over the movable bar 4.

Figure 6:
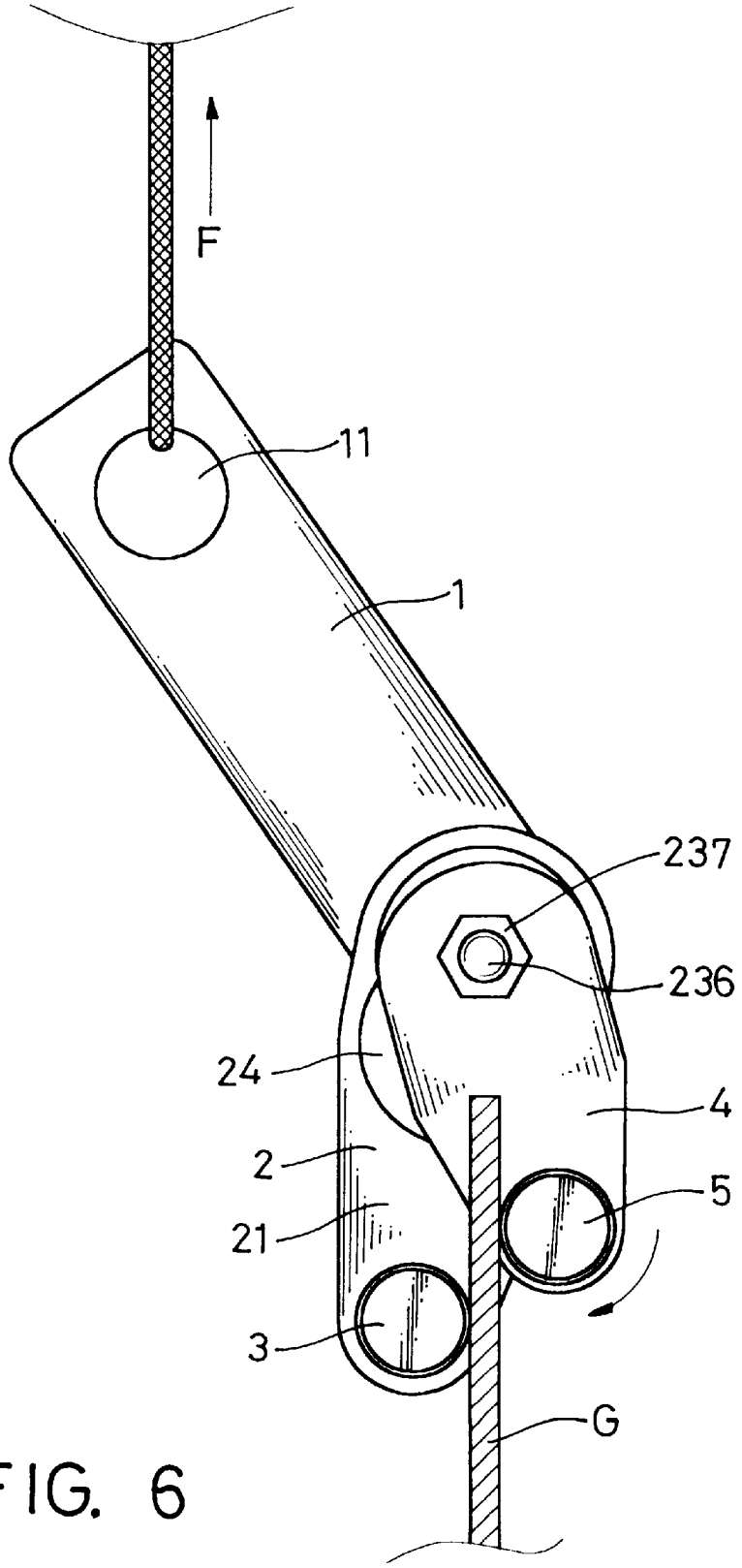
FIG. 6 illustrates an application example of the present invention.

Referring to FIG. 6, the workpiece (object to be lifted, for example, a shaped steel) G is attached to the supporting bar 3 at one side, then the handle 25 is operated to turn the sector member 251 for enabling the ratchet wheel 23 to be rotated clockwise, and then the clamping bar 5 is turned with the movable bar 4 and the ratchet wheel 23 and stopped at the workpiece G against the supporting bar 3, and then a lifting force F is applied to the hanging hole 11 at the link 1 to lift the safety clamp and the workpiece G. When lifting, a pressure is given to the workpiece G against the supporting bar 3 through the clamping bar 5, therefore the workpiece G is firmed retained in a vertical position between the supporting bar 3 and the clamping bar 5.

Figure 7:
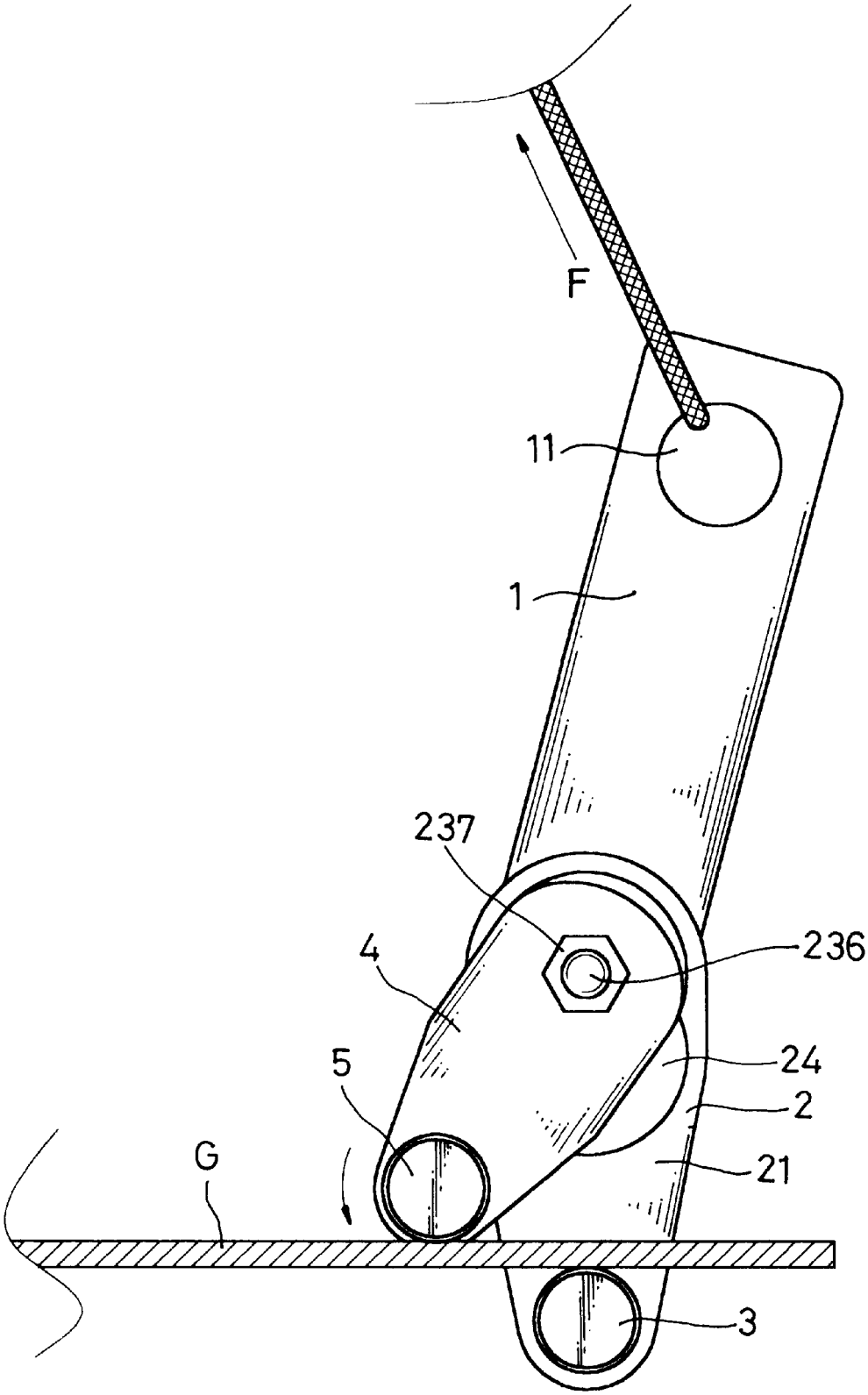
FIG. 7 illustrates another application example of the present invention.

Referring to FIG. 7, the workpiece G is placed on the supporting bar 3 at the top, then the handle 25 is operated to turn the sector member 251 for enabling the ratchet wheel 23 to be rotated counter-clockwise, and then the clamping bar 5 is turned with the movable bar 4 and the ratchet wheel 23 and stopped at the workpiece G against the supporting bar 3, and then a lifting force F is applied to the hanging hole 11 at the link 1 to lift the safety clamp and the workpiece G. When lifting, a pressure is given to the workpiece G against the supporting bar 3 through the clamping bar 5, therefore the workpiece G is firmed retained in a horizontal position between the supporting bar 3 and the clamping bar 5.

While only one embodiment of the present invention has been shown and described, it will be understood that various modifications and changes could be made thereunto without departing from the spirit and scope of the invention disclosed.

What the invention claimed is:

1. A safety clamp comprising:

a link, said link having a hang hole for fastening to the cable of a lifting mechanism, and a coupling hole at an opposite end;

a steering mechanism, said steering mechanism comprising a casing having a receiving chamber and a locating hole at two distal ends, a ratchet mechanism mounted in said receiving chamber inside said casing, and a cover covered on said receiving chamber to hold said ratchet mechanism in place, said ratchet mechanism comprising a ratchet wheel rotated clockwise/counter-clockwise in said receiving chamber, and steering control means for controlling the direction of rotation of said ratchet wheel, said ratchet wheel comprising a first coupling rod raised from one side thereof and extended out of said casing and fastened to the coupling hole at said link, and a second coupling rod raised from an opposite side thereof and extended out of said cover;

a supporting bar connected to the locating hole at said casing of said steering mechanism;

a movable bar connected to the second coupling rod of said ratchet wheel and turned with said ratchet wheel and said link and defining with said link a contained angle, said movable bar comprising a first coupling hole at one end fastened to the second coupling rod of said ratchet wheel outside said casing, and a second coupling hole at an opposite end;

a clamping bar connected to the second coupling hole at said movable bar and worked with said supporting bar to hold an object between said clamping bar and said supporting bar for enabling the object to be lifted with the safety clamp.

2. The safety clamp of claim 1 wherein said steering control means comprises a first pawl and a second pawl respectively pivoted to said casing inside said receiving chamber at two opposite sides of said ratchet wheel, a first spring member mounted inside said receiving chamber and connected between said casing and said first pawl to force said first pawl into engagement with said ratchet wheel, a second spring member mounted inside said receiving chamber and connected between said casing and said second pawl to force said second pawl into engagement with said ratchet wheel, a sector member pivoted to said casing inside said receiving chamber and spaced between said first pawl and said second pawl, and a handle suspended outside said casing and connected to said sector member for operation by hand to turn said sector member between a first position where said first pawl is disengaged from said ratchet wheel for enabling said ratchet wheel to be rotated in one direction, and a second position where said second pawl is disengaged from said ratchet wheel for enabling said ratchet wheel to be rotated in the reversed direction.

3. The safety clamp of claim 1 wherein the first coupling rod of said ratchet wheel comprises a stop portion stopped against said link at one side, an insertion portion fitted into the coupling hole at said link, and a threaded portion screwed up with a lock nut being stopped at one side of said link opposite to the stop portion of said first coupling rod; the second coupling rod of said ratchet wheel comprises a stop portion stopped against said movable bar at one side, an insertion portion fitted into the first coupling hole at said movable bar, and a threaded portion screwed up with a lock nut being stopped at one side of said movable bar opposite to the stop portion of said second coupling rod.

4. The safety clamp of claim 1 wherein said supporting bar comprises an insertion portion extended from one end thereof and fitted into the locating hole at said casing, and a threaded portion axially extended from the insertion portion of said supporting bar and screwed up with a lock nut being stopped at one side of said casing; said clamping bar comprises an insertion portion extended from one end thereof and fitted into the second coupling hole at said movable bar, and a threaded portion axially extended from the insertion portion of said clamping bar and screwed up with a lock nut being stopped at one side of said movable bar.

5. The safety clamp of claim 1 wherein said supporting bar and said clamping bar each have an embossed peripheral wall.

6. The safety clamp of claim 1 wherein the contained angle which is defined between said link and said movable plate is preferably within about 140° to 150° angle, or most preferably at about 145° angle.

7. The safety clamp of claim 1 wherein the length of said link is preferably about 2 to 4 times over said movable bar, or most preferably about 2.5 to 3 times over said movable bar.

* * * * *